United States Patent [19]

Nugent

[11] Patent Number: 4,527,609

[45] Date of Patent: Jul. 9, 1985

[54] CONTINUOUS CASTING PLANT FOR CONTINUOUSLY CASTING A METAL MELT

[75] Inventor: Thomas J. Nugent, Stamford, Conn.

[73] Assignee: Voest-Alpine International Corporation, New York, N.Y.

[21] Appl. No.: 492,207

[22] Filed: May 6, 1983

[51] Int. Cl.[3] ..... B22D 11/10; B22D 11/14

[52] U.S. Cl. ..... 164/253; 164/418; 164/438; 164/444

[58] Field of Search ..... 164/437, 418, 438, 410, 164/444, 474, 253; 266/158

[56] References Cited

U.S. PATENT DOCUMENTS

| | | | |
|---|---|---|---|
| 2,568,525 | 9/1951 | Waddington et al. | 164/438 X |
| 3,352,350 | 11/1967 | Dore et al. | 164/410 X |

FOREIGN PATENT DOCUMENTS

| | | | |
|---|---|---|---|
| 2930354 | 2/1981 | Fed. Rep. of Germany | 266/158 |
| 2413154 | 7/1979 | France | 164/418 |
| 53-52240 | 5/1978 | Japan | 164/474 |
| 365915 | 11/1979 | U.S.S.R. | 164/418 |

*Primary Examiner*—Nicholas P. Godici
*Assistant Examiner*—J. Reed Batten, Jr.
*Attorney, Agent, or Firm*—Horst M. Kasper

[57] ABSTRACT

A plant for continuously casting a metal, in particular steel, is provided comprising an open-ended mold. In order to provide an arrangement by which the hazards to the operators due to the emissions emerging from the mold are prevented, with an unobstructed view into the mold cavity being ensured, an emission collecting device covering the mold cavity and connected to an exhaust duct is provided above the mold at a distance therefrom to suck off the emissions emerging from the mold.

6 Claims, 2 Drawing Figures

CONTINUOUS CASTING PLANT FOR CONTINUOUSLY CASTING A METAL MELT

The invention relates to a plant for continuously casting metal, in particular steel, comprising an open-ended mold.

In continuous casting plants equipped with open-ended molds it is a common practice for metallurgical reasons to cover the bath level in the mold with a mold powder or oil. When in contact with the molten metal, these powders and/or oils generate emissions, which are hazardous to the operators. Since the bath level, or the bath level covered by the mold powder, in the mold must be visible, it is difficult to provide a suitable cover for the mold.

The invention aims at providing an arrangement by which the hazards to the operators due to the fumes emerging from the mold are prevented, wherein, however,an unobstructed view into the mold cavity is ensured.

This object is achieved according to the invention in that an exhaust hood covering the mold cavity and connected to an exhaust duct is provided above the mold and at a distance therefrom, to suck off the emissions emerging from the mold.

In order to take into account the lack of space on the casting floor, the exhaust hood and the stage of the exhaust duct following upon the exhaust hood advantageously are provided on the lower side of the tundish in a continuous casting plant that comprises a tundish arranged above an open-ended mold.

According to a preferred embodiment, the exhaust duct is formed by a first stage provided on the tundish, a second stage provided on a carrying arm or car carrying the tundish and movable therewith, and a third, stationary stage leading into a spray chamber cooling the strand emerging from the mold. With the tundish and carrier in the casting position, the second stage aligns with the first and the third stages in a duct-like manner.

Suitably, the third exhaust duct stage is connected to an exhaust system of the spray chamber.

The arrangement is particularly space-saving, if the exhaust hood and the first stage of the exhaust duct are incorporated and integrated into the bottom of the tundish and are formed by the supporting structure of this bottom.

Figure 1:
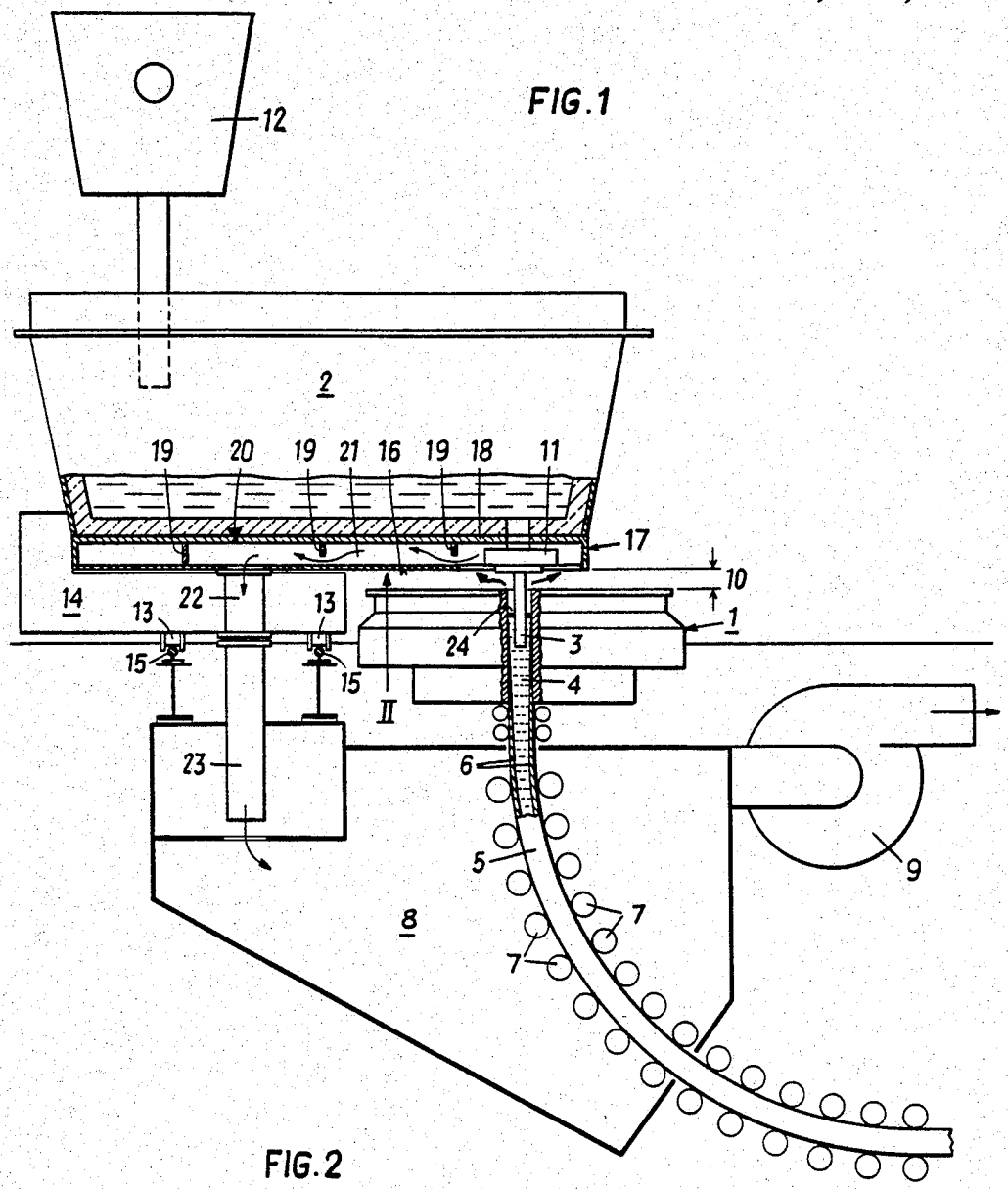
Figure 2:
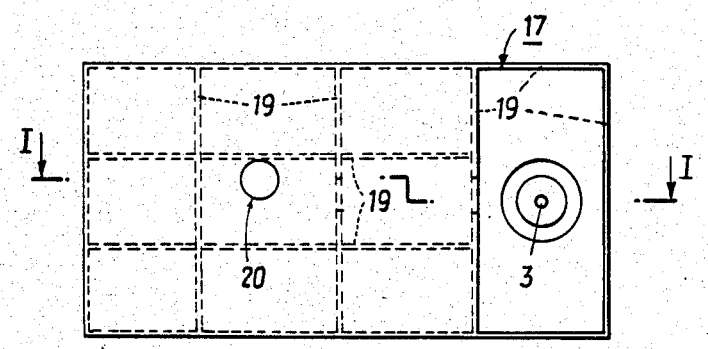

The invention will now be described by one embodiment and with reference to the accompanying drawings, wherein:

FIG. 1 shows the elevation of a plant for continuously casting a metal in a schematic illustration, in a partially sectioned side view; and FIG. 2 is a view of the bottom of the tundish in the direction of the arrow II of FIG. 1.

Molten steel flows through a casting tube 3 mounted to a tundish 2 into an oscillating open-ended mold 1. The casting tube 3 immerses in the liquid sump 4 of the strand 5 present in the mold. The strand 5, which emerges from the mold and has a thin strand skin 6, requires cooling and support. Water is sprayed against the hot strand in order to cool it and the strand support rollers 7 arranged within a spray chamber 8.

A fan 9 produces a negative pressure in the spray chamber 8, thereby preventing steam that forms in the spray chamber from escaping into the caster building.

The fan conveys the steam through ducts into a stack or to a heat recovering plant.

The tundish 2, to which the casting tube 3 is fastened with a slide 11 interposed, is arranged at a distance 10 above the mold 1. The liquid steel thus flows from a casting ladle 12 into the tundish 2 and only from there into the mold 1. The tundish 2 is arranged on a car 14 comprising wheels 13 and being movable along rails 15 into the position above the mold 1. Instead of the car 14, any other means (e.g, the carrying arm of a rotary tower) may be provided, which enable the positioning of the tundish above the mold 1, as illustrated in FIG. 1.

On the lower side 16 of the tundish 2, an exhaust hood 17 or an arrangement collecting emissions from the mold 1, is provided at a distance 10 above the mold 1 and formed by carriers 19 reinforcing a bottom plate 18 of the tundish. Upon this exhaust hood 17 an exhaust duct follows, which is generally denoted by 20, whose first stage 21 following upon the hood also is formed by the bottom structure of the tundish 2. This first stage of the exhaust duct aligns with a second stage 22 incorporated into the car 14. The second stage in turn aligns in casting position with a third stage 23 that is stationary and attached to the spray chamber 8. In case a rotary tower is provided, the second stage 22 of the exhaust duct 20 penetrates the carrying arm of the rotary tower holding the tundish.

The third stage 23 of the exhaust duct 20 leads into the spray chamber 8, the depression prevailing within the cooling chamber thus serving to evacuate the emissions rising from the mold. By arranging the exhaust hood 17 at a distance 10 above the mold 1, it is still possible to observe the meniscus in the mold 1, which is covered with a layer of mold powder 24.

The particular advantage of the construction according to the invention is to be seen in the fact that the exhaust hood 17 is always in the right position if the tundish 2 is in the casting position, because both exhaust hood 17 and first stage 21 of the exhaust duct form integral parts of the tundish.

In order to ensure a tight connection of the exhaust duct stages 21, 22, 23, the stages 21, 22, 23 may comprise transition pieces that allow for relative movements of the tundish 2 with respect to the tundish car 14 and relative movements of the tundish car 14 with respect to the third exhaust duct stage 23.

The invention is not limited to the embodiment illustrated in the drawings, but may be modified in various aspects. For instance, the exhaust duct 20 need not run into the spray chamber 8, but may be equipped with an own fan and exhaust system.

What I claim is:

1. In a plant for continuously casting a metal, in particular steel, comprising an open-ended mold defining a mold cavity;

a tundish arranged above the open-ended mold;

an emission collecting means provided above said mold at a distance therefrom and covering said mold cavity so as to suck off emissions emerging from said mold cavity;

an exhaust duct connected to said emission collecting means and including an exhaust duct stage following upon said emission collecting means and being provided on the lower side of said tundish together with said emission collecting means.

2. A plant as set forth in claim 1, further comprising a carrying means for said tundish, and a spray chamber for cooling the strand emerging from said mold, and wherein said exhaust duct is formed by a first exhaust duct stage provided on said tundish, a second exhaust duct stage provided on said carrying means and movable therewith, and a third exhaust duct stage stationary and leading into said spray chamber, said second exhaust duct stage, in the casting position of said tundish, aligning with said first exhaust duct stage and said third exhaust duct stage in a duct-like manner.

3. A plant as set forth in claim 2, wherein said carrying means is designed as a carrying arm.

4. A plant as set forth in claim 2, wherein said carrying means is designed as a car.

5. A plant as set forth in claim 2, further comprising a spray chamber exhaust system, and wherein said third exhaust duct stage is connected to said spray chamber exhaust system.

6. A plant as set forth in claim 2, 3, 4 or 5, comprising a tundish bottom and a tundish bottom supporting structure provided for said tundish, and wherein said emission collecting means and said first exhaust duct stage are incorporated and integrated into said tundish bottom and are formed by said tundish bottom supporting structure.

* * * * *